United States Patent [19]

Feige et al.

[11] Patent Number: 4,632,012

[45] Date of Patent: Dec. 30, 1986

[54] FIRE CONTROL SYSTEM FOR MOVING WEAPON CARRIERS

[75] Inventors: Christian Feige, Grafing; Bertold Kirst, Merzhausen, both of Fed. Rep. of Germany

[73] Assignee: LITEF der Hellige GmbH, Freiburg im Breisgau, Fed. Rep. of Germany

[21] Appl. No.: 647,141

[22] Filed: Sep. 4, 1984

[30] Foreign Application Priority Data

Sep. 9, 1983 [DE] Fed. Rep. of Germany ..... 3332795

[51] Int. Cl.[4] ..... F41G 5/16; F41G 3/04

[52] U.S. Cl. ..... 89/41.09; 89/41.11; 89/41.19; 364/423; 235/407

[58] Field of Search ..... 89/41.09, 41.19, 41.11, 89/37.09, 41.17; 33/236, 237, 238; 235/407, 411, 412, 413, 414, 415, 416; 364/423

[56] References Cited

U.S. PATENT DOCUMENTS

| | | | |
|---|---|---|---|
| 3,405,599 | 10/1968 | Barlow et al. | 89/41.09 |
| 3,551,688 | 12/1970 | Edelson | 89/41.03 |
| 3,803,387 | 4/1974 | Lackowski | 89/41.09 |
| 3,829,659 | 8/1974 | Margolis | 235/407 |
| 3,997,762 | 12/1976 | Ritchie et al. | 89/41.19 |
| 4,166,406 | 9/1979 | Maughmer | 364/423 |
| 4,507,737 | 3/1985 | LaSarge et al. | 364/453 |

FOREIGN PATENT DOCUMENTS

| | | |
|---|---|---|
| 3019743 | 5/1980 | Fed. Rep. of Germany . |
| 3229819 | 2/1984 | Fed. Rep. of Germany . |

OTHER PUBLICATIONS

"Electronic Inclinometer Eliminates Field Leveling Requirements" Defense Electronics, Dec. 1979, p. 37.

Merrill, G., Dictionary of Guided Missiles and Space Flight, 1959, pp. 296–300.

*Primary Examiner*—Stephen C. Bentley
*Assistant Examiner*—Stephen Johnson
*Attorney, Agent, or Firm*—Elliott N. Kramsky

[57] ABSTRACT

A fire control system for a mobile weapon carrier incorporates a strapdown sensor block that includes inertial sensors. The digital outputs of the sensor block are utilized for weapon and sight stabilization, fire control and navigation with the aid of a signal processing system that includes a central digital computer, control and stabilization transducers associated with both sight and weapon, and a display for navigational data.

4 Claims, 6 Drawing Figures

FIRE CONTROL SYSTEM FOR MOVING WEAPON CARRIERS

BACKGROUND

1. Field of the Invention

This invention relates to a fire control and navigational system for moving weapon carriers. More particularly, this invention pertains to such a system which is particularly suitable for battle tanks and other vehicles of the type that possess a primary and secondary-stabilized system movable relative to the vehicle.

2. Description of the Prior Art

In order to realize maximum usefulness, modern weapon systems must often be utilized in conjunction with moving weapon carriers. For weapons with a ballistic action, this requires some compensation of the various "disturbance variables" that occur when the projectile is fired. Accurate compensation requires knowledge of the movement of the weapon or, alternatively, stabilization of the weapon.

In a modern main battle tank, ballistic trajectories and ranges are determined by the elevation angle of the freely movable barrel. When a gun barrel that is movable about the vertical angle in azimuth and about an orthogonal axis in elevation is used with a moving vehicle, movement of the weapon carrier must be compensated to stabilize the weapon. Conventionally, the fire control system of a main battle tank is stabilized by employing several gyroscope sets as sensors for the primary stabilization of sighting means and the weapon system. Such a gyroscope set comprises, as a rule, two one degree-of-freedom rate gyroscopes that are mounted on the weapon. These serve to measure rotary movements about the elevation and azimuth axes and to compensate such movements by means of an associated closed loop control system employing servo drives. Additionally, the cant angle of the weapon must be detected by means of a perpendicularity sensor. Rate gyroscopes in the turret and hull prestabilize the weapon.

The battle tank as a directly aimed weapon possesses optical sights that enable the commander and gunner to detect target position. Once again, stabilization for use during travel is required in order that the weapon's line of sight may be stabilized. In the event that the sights are primary stabilized, such viewing devices must include two sets of uniaxial rate gyroscopes with appropriate servo-drives and control loops. This requires three primary-stabilized devices and, hence, six rate gyroscopes per tank. The rate gyroscopes are interactive; thus, when one gyroscope set fails, others are effected in their performances. Further, conventional gyroscopes often fail to provide guidance information, in the form of navigational data, in a suitable manner.

In a conventional main battle tank as described above, firing from a fast-moving weapon is accomplished only with reduced accuracy for a number of reasons. First, weapon movement cannot be completely known, as the aforementioned gyroscopes only measure rates of rotation. Translational movement of the weapon, for example, is not provided. (as shown in FIG. 1, the vehicle speed $V_F$ as well as the aiming speed $V_R$ (swing-angle speed $W_R$) and the muzzle velocity $V_O$ of the projective are superimposed; thus, actual projectile velocity $V_G$ is obtained.)

Secondly, stabilization is conventionally carried out only as a directional stabilization. That is, the weapon's direction vector is maintained independent of the rates of rotation of the weapon carrier that occur. This phenomenon is illustrated in FIG. 2, a conceptual illustration of the weapon aiming process for a directionally stabilized (positive azimuth angle) gun barrel on a vehicle travelling over uneven terrain. Thus, the weapon may be stabilized directionally in space although with a parallel displacement. Depending on the direction of travel of the weapon carrier and target, relatively large translational displacements can occur that cannot be compensated by the stabilizing system alone.

Third, translational displacements can be compensated by the use of so-called auxiliary aiming aids and dynamic lead prediction wherein the gunner presets the aiming speed used by the fire control system for lead computation. Unfortunately, the aiming-angle speed $W_{RS}$ contains components of both the speed of the weapon carrier $W_Y$ and the speed of the target $V_F$ (see FIG. 3). The target speed must, however, be compensated according to the lead angle $W_V$ while the speed of the weapon carrier must be treated as a ballistic disturbance variable at the time the projectile is fired. Because two items of information are thus mixed in the aiming signal $W_{RS}$, the weapon carrier must be stopped for a short time at the moment of firing to isolate the necessary information. Otherwise, a considerable burden is placed upon the gunner. Considerable experience is required to decide how accurately a projectile has struck a moving target when the weapon carrier is in motion. As a rule, dynamic lead predictions cannot be made correctly even when aided by auxiliary aiming aids.

Finally, the single axis rate gyroscopes often found in present-day weapon stabilizing systems provide an analog output of generally inadequate bandwidth and stability. Consequently, it is almost impossible to use measured rates of rotation for other system functions.

SUMMARY OF THE INVENTION

The preceding and other shortcomings of the prior art are addressed and overcome by the present invention which provides an improved fire control system for a mobile weapon carrier of the type that includes a weapon and apparatus for sighting a target. Such system includes means adapted to produce a signal in response to movement of the apparatus for sighting a target. Further, means are provided for a accepting such signal and providing first and second control signals in response thereto. Means for adjusting the sighting apparatus in response to the first control signal and means for adjusting the weapon in response to a second control signal are additionally provided.

The foregoing and other features of this invention will become further apparent from the description that follows. This description is supplemented by a set of illustrative drawing figures wherein numerals identify various features, like numerals referring to like features of the invention throughout both the written description and drawing figures.

DETAILED DESCRIPTION

Figure 1:
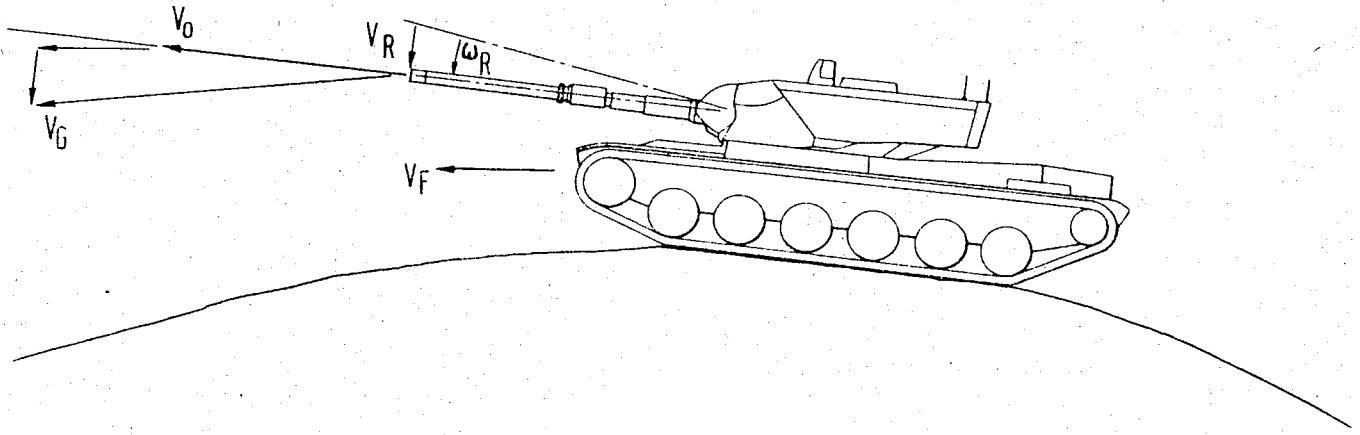
FIGS. 1, 2 and 3 are models of theoretical concepts involved in the aiming of a weapon engaged to a mobile carrier.
Figure 2:
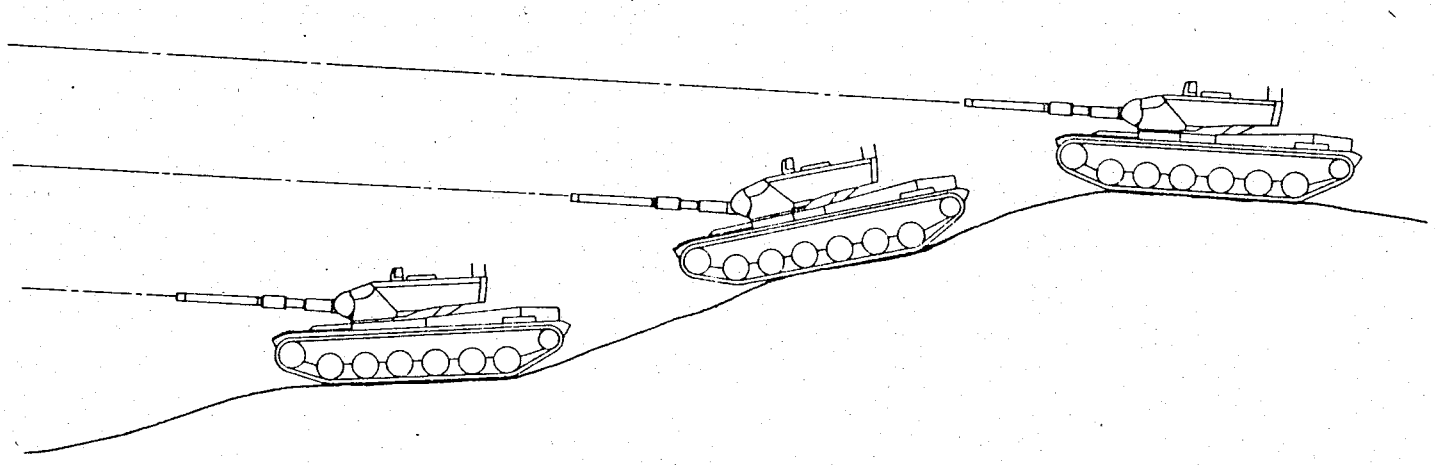
Figure 3:
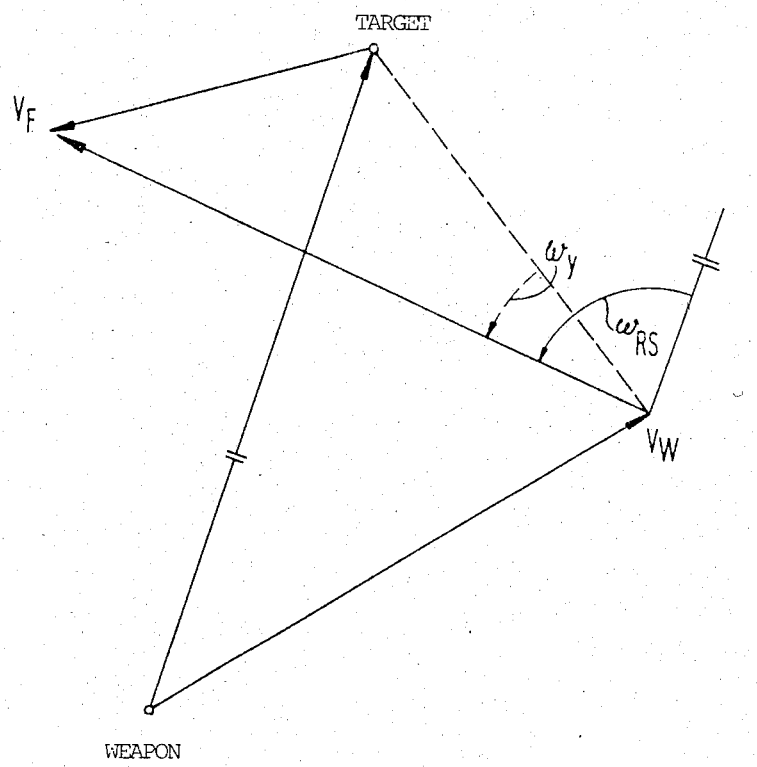
Figure 4:
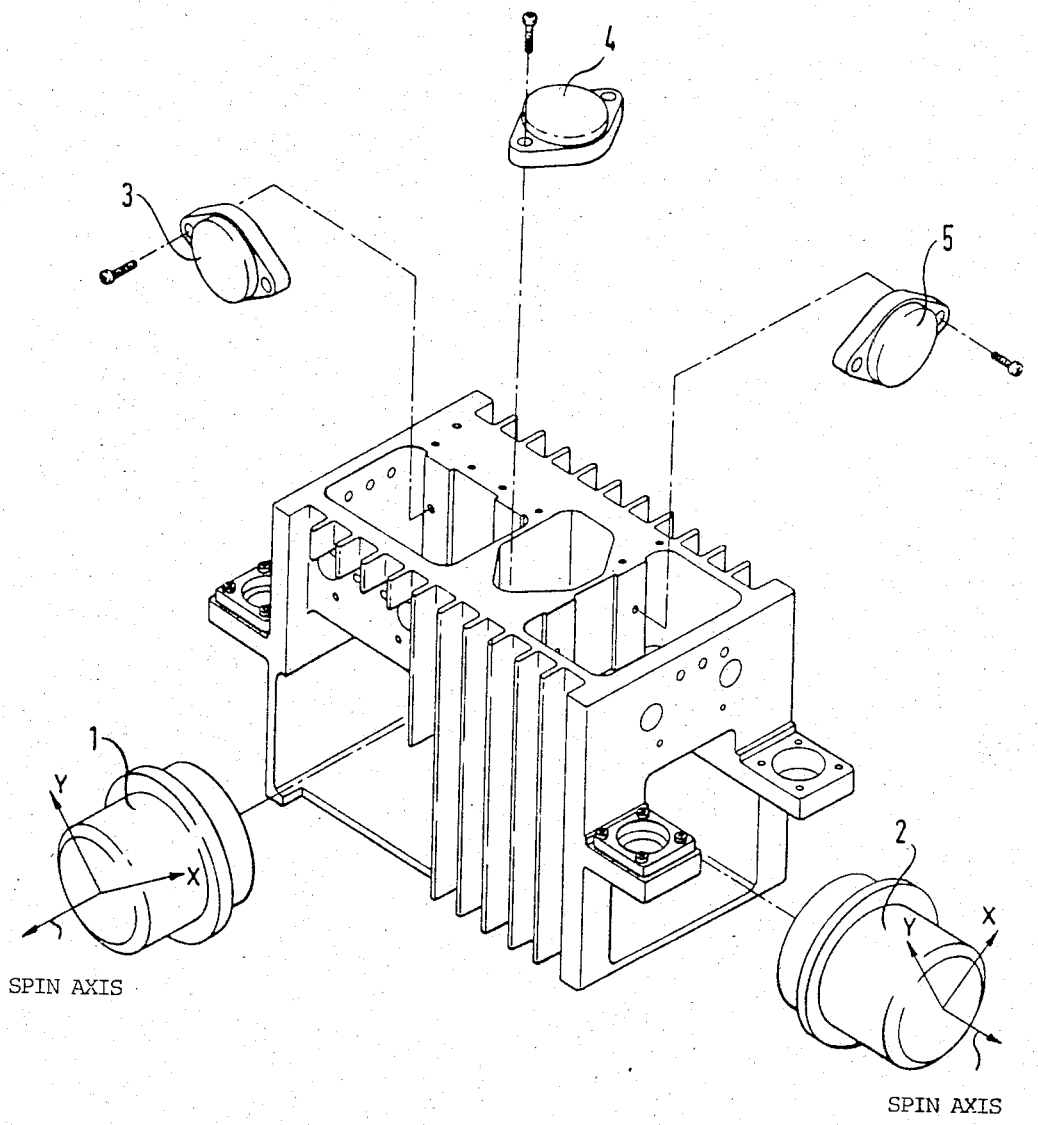
FIG. 4 is an exploded perspective view of the strapdown sensor block of the invention.

Turning now to the drawings, FIG. 4 illustrates a strapdown sensor block in accordance with the invention. The block includes two dry dynamically tuned two degree-of-freedom gyroscopes 1 and 2. The gyroscopes 1 and 2 are arranged orthogonally to one another and to three pendulous single-degree-of-freedom accelerometers 3, 4 and 5. The accelerometers 3, 4 and 5 determine vehicle acceleration along three orthogonal axes while the gyroscopes 1 and 2 measure rates of rotation along three orthogonal axes. By integration of the accelerations into the sensor block, the speed of the vehicle may be determined. Distances are obtained by integration of the speed and, assuming the initial position and speed of the vehicle are also known, navigation is possible. That is, the position of the vehicle in three-dimensional space may be determined through straightforward computation.

To ensure complete navigational independence, the present invention provides self-alignment (i.e. independent determination of true north). While measured rates of rotation can be used for primary stabilization of the vehicle carrying the gyroscopes, these values may also be employed for secondary stabilization of additional devices.

The sensor block of the invention may be employed in a battle tank having a stabilized weapon and stabilized optical sight. The strapdown block of FIG. 4, having the gyroscopes 1 and 2 and the accelerometers 3, 4 and 5, may be integrated into the viewing device for primary stabilization of the weapon line of sight and, at the same time, may be used for secondary stabilization of the weapon itself. Unlike prior art stabilization systems discussed above, the block 8 includes all necessary sensor instrumentation, in sharp contrast to the many sets of gyroscopes employed for each of a number of functions in a conventional main battle tank.

Figure 5:
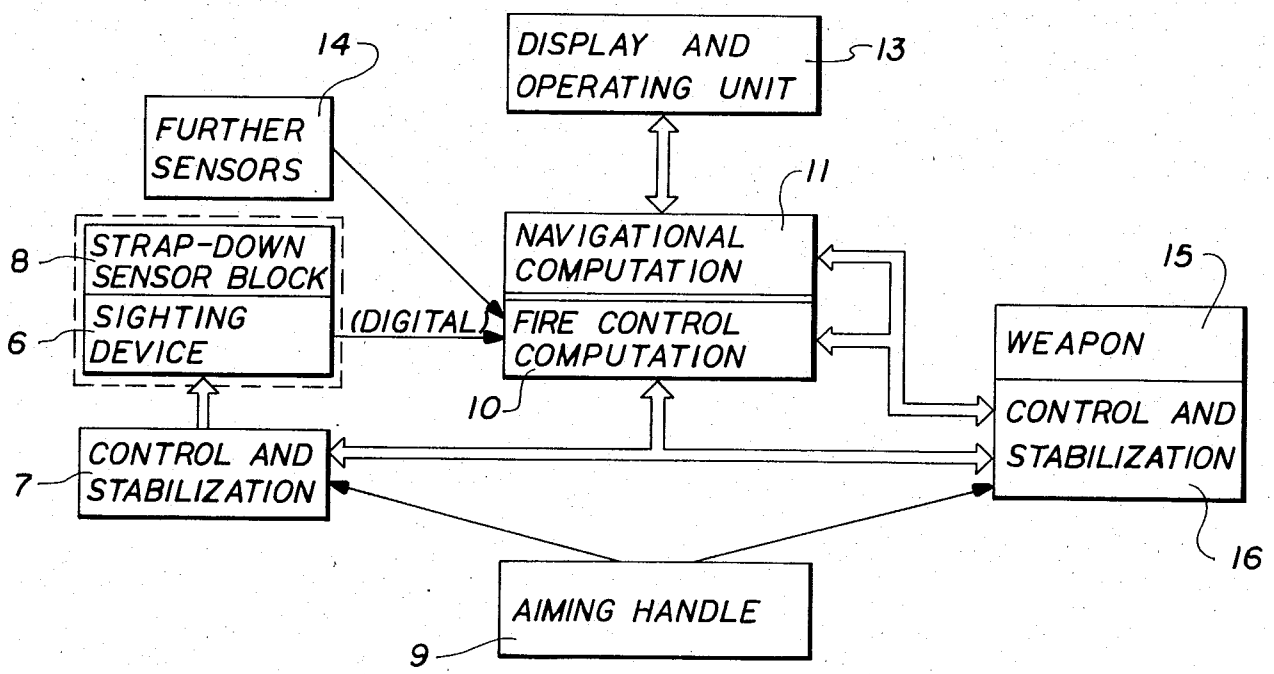
FIG. 5 is a block diagram of the fire control system of the invention.

FIG. 5 is a block diagram of the fire control system of the invention. The strapdown sensor block shown in detail in the preceding figure and identified by the numeral 8 in FIG. 5, is integrated into a sighting device 6 that is primary-stabilized by means of a controller and servo-drive 7. The rates of rotation determined for stabilization purposes are also utilized by the control electronics 16 of a weapon 15 for secondary stabilization. To improve stabilization quality, the weapon 15 may be restabilized by means of a fire control computer 10. The fire control computer 10 makes straightforward calculations of ballistic values and lead and elevation as a function of the type of projectile. The command variable can be transmitted as the aiming speed to the sighting device and weapon via a control handle 9.

A navigation computer 11 determines speed and position relative to the carrier vehicle from the rates of rotation and the accelerations measured by the strapdown sensor block 8. The digital format of the output from the sensor block 8 permits direct computation of ballistic values during fire control. A display and operating unit 13 displays these values in appropriate coordinates; for example, position might be shown in UTM coordinates. Additional sensors 14, such as thermal-imaging night-viewing devices, may be usefully integrated into the overall system.

As is seen, sensors are utilized in accordance with the system of FIG. 5, not only for stabilization but also to obtain position data pertaining to the carrier vehicle. Further, the angular position of the weapon, which is required for compensation of canting, is obtained. The system provides complete knowledge of weapon movements during firing, allowing compensation for ballistic disturbance variables.

Figure 6:
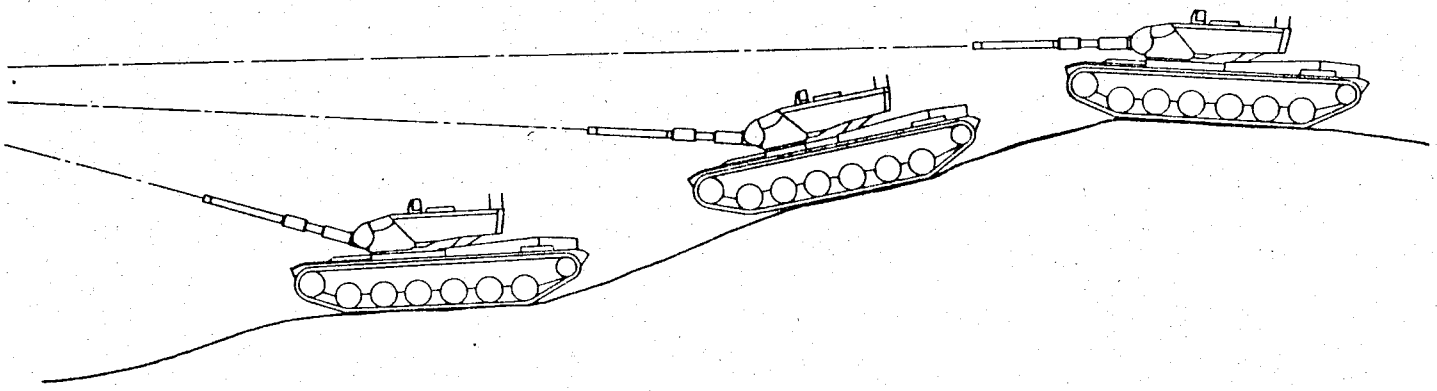
FIG. 6 is a model of the point stabilization rotation mode for a gun barrel engaged to a mobile carrier.

FIG. 6 is an illustration of the rotation mode of a point stabilized gun barrel. As is evident, this improved mode of operation overcomes the inaccuracies that result from parallel position barrel translation that characterize directionally stabilized systems. Actual target movement can be determined as an incident of the aiming function, since vehicle movement is known. As a result, one may achieve accurate dynamic lead prediction and, at the same time, proper ballistic compensation.

A further advantage of coupling navigational and directional reference capabilities makes indirect firing of the weapon (i.e., without a direct visual link with the target) possible. This allows the weapon to be used for new tactical operations. For example, helicopter defense and artillery support may be employed in the event of a concentration of fire. Further, the navigational capacity offers the commander additional guidance aids such as an indication of the position of his own vehicle and of the position of other vehicles in his troop. This eliminates the need for a visual link between friendly vehicles.

Thus, it is seen that there has been brought to the fire control and weapons stabilization arts a new and improved system for use with a mobile carrier. The system of the invention measures all the information necessary for fire control and for stabilization of the weapon under all conceivable conditions of movement of the weapon carrier and target and additionally provides navigation information for tactical uses. By utilizing the apparatus and teachings herein, the accuracy of the fire control system as a whole is improved, and new tactical uses become possible.

In addition to the advantages already outlined, this system requires relatively little outlay in comparison with the multiple rate gyroscopes sets employed in prior art systems. The digital navigation system requires no complicated, expensive mechanical parts other than the inertial sensors allowing all task-oriented functions to be executed independently and without the possibility of faults.

While the system has been illustrated in its presently preferred embodiment, this invention is not so limited but only insofar as it is defined in the following set of claims, and in all equivalents thereto.

What is claimed is:

1. A fire control system for a moving weapon carrier of the type that includes a weapon and a sighting device comprising, in combination:

a. a single sensor apparatus for producing rotation and translation information in digital form, said apparatus being strapped down to said sighting device;

b. a digital computer for accepting said information, said computer being arranged to calculate and then to control a plurality of predetermined functions simultaneously, said plurality of functions including the primary stabilization of said sighting device and the secondary stabilization of said weapon;

c. means responsive to the output of said digital computer for stabilizing said sighting device; and d. means responsive to the output of said digital computer for stabilizing said weapon.

2. A fire control system as defined in claim 1 additionally characterized in that:

a. said plurality of predetermined functions includes determining the position of said weapon carrier and determining ballistic values; and b. said system includes means responsive to the output of said digital computer for aiming said weapon.

3. A fire control system as defined in claim 2 further including means responsive to the output of said digital computer for visually displaying said inertial information.

4. A fire control system as defined in claim 3 wherein said sensor apparatus comprises a single sensor block that includes:

a. two dry-tuned gyroscopes, each of said gyroscopes having two degrees of freedom; and b. three linear single degree-of-freedom pendulous accelerometers.

* * * * *